US009187939B1

(12) United States Patent
Bishop

(10) Patent No.: US 9,187,939 B1
(45) Date of Patent: Nov. 17, 2015

(54) SAFETY GATE LOCKING STRAP AND A SAFETY GATE ASSEMBLY INCLUDING THE SAME

(71) Applicant: Jason David Bishop, Blacklick, OH (US)

(72) Inventor: Jason David Bishop, Blacklick, OH (US)

( * ) Notice: Subject to any disclaimer, the term of this patent is extended or adjusted under 35 U.S.C. 154(b) by 0 days.

(21) Appl. No.: 14/524,167

(22) Filed: Oct. 27, 2014

Related U.S. Application Data

(60) Provisional application No. 61/931,646, filed on Jan. 26, 2014.

(51) Int. Cl.

| | |
|---|---|
| ***E06B 9/02*** | (2006.01) |
| ***E05C 19/18*** | (2006.01) |
| ***E06B 9/00*** | (2006.01) |
| ***E06B 9/01*** | (2006.01) |
| ***E06B 11/04*** | (2006.01) |
| ***E06B 9/06*** | (2006.01) |
| ***E05C 19/10*** | (2006.01) |

(52) U.S. Cl.
CPC ..... *E05C 19/188* (2013.01); *E05C 19/10* (2013.01); *E06B 9/00* (2013.01); *E06B 9/01* (2013.01); *E06B 9/06* (2013.01); *E06B 11/04* (2013.01); *E06B 2009/002* (2013.01)

(58) Field of Classification Search
CPC . E06B 9/02; A44B 11/266; E05B 2015/1692; F16B 7/0406; F16B 7/0433; B65D 63/10; B65D 63/1018; B65D 63/1027; B65D 63/1063
USPC ..... 49/55, 57
See application file for complete search history.

(56) References Cited

U.S. PATENT DOCUMENTS

| | | | | |
|---|---|---|---|---|
| 1,510,403 A | | 9/1924 | Jones | |
| 2,722,449 A | | 11/1955 | Harley | |
| 2,779,617 A | | 1/1957 | Hammond | |
| 3,147,030 A | | 9/1964 | Berk | |
| 3,216,482 A | * | 11/1965 | Lindholm | 160/216 |
| 3,431,966 A | * | 3/1969 | Injeski | 160/225 |
| 3,720,431 A | | 3/1973 | Oliver et al. | |
| 4,150,464 A | | 4/1979 | Tracy | |
| 4,254,975 A | | 3/1981 | Miller | |
| 4,662,010 A | | 5/1987 | Silberling | |
| 4,683,934 A | | 8/1987 | Salsness | |

(Continued)

OTHER PUBLICATIONS

First office action on the merits (Non-Final Rejection) in U.S. Appl. No. 13/456,219, mailed on Oct. 23, 2013.

*Primary Examiner* — Katherine Mitchell
*Assistant Examiner* — Abe Massad
(74) *Attorney, Agent, or Firm* — The Law Office of Patrick F. O'Reilly, III, LLC

(57) ABSTRACT

A safety gate locking strap configured to prevent an opening of a safety gate by a child or pet is disclosed herein. In one or more embodiments, the safety gate locking strap includes a strap portion having a first end portion and an oppositely disposed second end portion; a fastening member coupled to the strap portion, which is configured to enable the first end portion of the strap portion to be engaged to, and disengaged from, the second end portion of the strap portion by a user; and a protrusion extending from the strap portion, the protrusion configured to engage with a groove in a component of a safety gate so as to prevent the safety gate from being opened by a child or a pet. A safety gate assembly and method of securing a safety gate, each of which utilize the safety gate locking strap, are also disclosed herein.

14 Claims, 9 Drawing Sheets

(56) References Cited

U.S. PATENT DOCUMENTS

| | | | | |
|---|---|---|---|---|
| 4,991,272 | A | 2/1991 | Bianchi | |
| 5,098,140 | A | 3/1992 | Kentner | |
| 5,452,929 | A | 9/1995 | Anderson | |
| 5,623,841 | A | 4/1997 | Deemar | |
| 5,716,084 | A | 2/1998 | Sanford, Jr. et al. | |
| 5,791,026 | A | 8/1998 | Anscher | |
| 6,101,687 | A | 8/2000 | Giampavolo et al. | |
| 6,189,348 | B1 | 2/2001 | Huang | |
| 6,263,549 | B1 | 7/2001 | Uehara | |
| 6,618,915 | B2 | 9/2003 | Giampavolo | |
| 6,640,509 | B2 * | 11/2003 | Clewis | 52/202 |
| 6,757,944 | B2 | 7/2004 | Buscart | |
| 6,880,717 | B1 | 4/2005 | O'Conor | |
| 7,464,448 | B2 * | 12/2008 | Kolasa | 24/616 |
| 8,069,540 | B2 * | 12/2011 | Obiols et al. | 24/306 |
| 2001/0013159 | A1 | 8/2001 | Maruoka | |
| 2002/0178766 | A1 | 12/2002 | Jackson, Jr. et al. | |
| 2003/0014851 | A1 | 1/2003 | Murai et al. | |
| 2004/0134046 | A1 | 7/2004 | Giampavolo | |
| 2006/0027798 | A1 * | 2/2006 | Winston | 256/65.01 |
| 2013/0285388 | A1 | 10/2013 | Bishop | |

* cited by examiner

DETAIL "A"

SECTION "A"

SAFETY GATE LOCKING STRAP AND A SAFETY GATE ASSEMBLY INCLUDING THE SAME

CROSS-REFERENCE TO RELATED APPLICATIONS

This patent application claims priority to, and incorporates by reference in its entirety, U.S. Provisional Patent Application No. 61/931,646, entitled "Adjustable Safety Gate Lock", filed on Jan. 26, 2014.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a safety gate locking strap and a safety gate assembly including the same. More particularly, the invention relates to a safety gate locking strap configured to prevent an opening of a safety gate by a pet or child, and a safety gate assembly that includes the safety gate locking strap to secure the safety gate.

2. Background

In homes occupied by small children and pets, portable barrier devices are frequently used in order to restrict access to a particular room or portion of the house. These barrier devices are typically placed within an opening to a room in the house (e.g., across a door opening leading to the room). When they are effective, these portable barrier devices operate as impassable barriers to the prohibited space or room so as to prevent the passage of the small child and/or pet through the access way into the space or room. As such, when effective, the portable barrier devices help to ensure the safety of the small child and/or pet by restricting them to a permissible area in the house (e.g., away from dangerous and/or restricted areas, such as stairs, and dangerous items in the house, etc.). Also, the portable barrier devices may be used to protect the contents of the space or room from potential damage that may be inflicted on the room contents by the small children and/or pets (e.g., damage to furniture, etc.).

However, these portable barrier devices commonly have a number of shortcomings that inhibit their effective use in homes. First of all, the latching device that is provided on these portable barrier devices for securing them in place is often able to be disengaged by the small child or pet, thereby circumventing the restriction imposed by the barrier device. For example, as a child gets older, he or she may eventually learn how to disengage the latching device on the portable barrier device. Similarly, a pet may be able to disengage the latching device by applying a sufficient force against the portable barrier device. In addition, an attempt to prevent the unwanted disengagement of the latching device on the portable barrier device by the small child or pet may result in a barrier device arrangement that inhibits the ability of the barrier device to be easily removed by an adult when required (e.g., placing obstructions in front of the barrier may help prevent the unwanted opening of the barrier, but it will also inhibit its intended functionality). Because these barrier devices are often restricting access between two rooms in a house, they need to be easily removable when the passage between the rooms is desired by adults.

Therefore, what is needed is a device for preventing the unwanted opening of a portable room barrier device or safety gate by a small child or pet. Moreover, a safety gate assembly is needed that effectively prevents the unwanted opening of a safety gate by utilizing a locking device that is virtually unable to be disengaged by a small child or pet. Furthermore, there is a need for a device that prevents the unwanted opening of a portable room barrier device or safety gate, but does not substantially interfere with the portability of the safety gate or the ability of an adult to remove the safety gate when desired.

BRIEF SUMMARY OF EMBODIMENTS OF THE INVENTION

Accordingly, the present invention is directed to a safety gate locking strap and a safety gate assembly including the same that substantially obviates one or more problems resulting from the limitations and deficiencies of the related art.

In accordance with one or more embodiments of the present invention, there is provided a safety gate locking strap configured to prevent an opening of a safety gate by a child or pet. The safety gate locking strap includes a strap portion having a first end portion and a second end portion, the first end portion of the strap portion being disposed opposite to the second end portion; a fastening member coupled to the strap portion, the fastening member configured to enable the first end portion of the strap portion to be engaged to, and disengaged from, the second end portion of the strap portion by a user; and a protrusion extending from the strap portion, the protrusion configured to engage with a groove in a component of a safety gate so as to prevent the safety gate from being opened by a child or a pet.

In a further embodiment of the present invention, the fastening member comprises a strap buckle with a first buckle portion and a second buckle portion, the first buckle portion configured to be engaged to, and disengaged from, the second buckle portion.

In yet a further embodiment, the first buckle portion comprises a tongue member and the second buckle portion comprises a recess for receiving the tongue member of the first buckle portion.

In still a further embodiment, the first buckle portion comprises at least one resilient locking tab and the second buckle portion comprises at least one tab receiving aperture, the first buckle portion configured to be engaged to, and disengaged from, the second buckle portion by means of a selective engagement between the at least one resilient locking tab and the at least one tab receiving aperture.

In yet a further embodiment, the at least one resilient locking tab of the first buckle portion comprises a pair of resilient locking tabs, each of the pair of resilient locking tabs being disposed on an opposite side of the tongue member of the first buckle portion; and the at least one tab receiving aperture of the second buckle portion comprises a pair of tab receiving apertures, each of the pair of tab receiving apertures being disposed on an opposite side of the recess of the second buckle portion, and each of the pair of tab receiving apertures being configured to receive a respective one of the pair of resilient locking tabs of the first buckle portion.

In still a further embodiment, the first buckle portion comprises a first strap retention portion for attaching the first end portion of the strap portion to the first buckle portion, and the second buckle portion comprises a second strap retention portion for attaching the second end portion of the strap portion to the second buckle portion; and wherein at least one of the first and second end portions of the strap portion are adjustable relative to a respective one of the first and second strap retention portions.

In yet a further embodiment, the safety gate locking strap further comprises a base plate disposed proximate to a base of the protrusion, the protrusion coupled to, and extending from, the base plate, the base plate being disposed against a first side of the strap portion.

In still a further embodiment, the safety gate locking strap further comprises a fastener member attaching the base plate to the strap portion, the fastener member including a head portion and a shaft portion, the head portion of the fastener member being disposed on a second side of the strap portion, the second side of the strap portion being disposed opposite to the first side of the strap portion, and the shaft portion of the fastener member either forming the protrusion or the shaft portion of the fastener member attaching the protrusion to the strap portion.

In yet a further embodiment, the fastener member comprises one of: (i) a rivet, (ii) a screw, and (iii) a locking pin.

In accordance with one or more other embodiments of the present invention, there is provided a safety gate assembly configured to prevent a child or a pet from entering a particular room in a dwelling structure. The safety gate assembly includes a safety gate configured to extend across a door opening or other opening into a room, the safety gate including a body portion with a first securement component and a second securement component; and a safety gate locking strap configured to prevent an opening of the safety gate by a child or pet. The safety gate locking strap comprises a strap portion having a first end portion and a second end portion, the first end portion of the strap portion being disposed opposite to the second end portion; and a fastening member coupled to the strap portion, the fastening member configured to enable the first end portion of the strap portion to be engaged to, and disengaged from, the second end portion of the strap portion by a user. In these one or more embodiments, when the first end portion of the strap portion is engaged with the second end portion by the fastener member, the strap portion of the safety gate locking strap is configured to circumscribe the first and second securement components of the safety gate so as to prevent the first and second securement components from becoming disengaged from one another and thereby prevent the safety gate from being opened.

In a further embodiment of the present invention, at least one of the first securement component and the second securement component of the safety gate comprises at least one groove formed therein; and the safety gate locking strap further comprises a protrusion extending from the strap portion, the protrusion configured to engage with the at least one groove formed in the at least one of the first securement component and the second securement component so as to further prevent the first and second securement components from becoming disengaged from one another and the safety gate from being opened.

In yet a further embodiment, the at least one groove formed in the at least one of the first securement component and the second securement component comprises a plurality of grooves spaced-apart along a length of the at least one of the first securement component and the second securement component, the protrusion of the safety gate locking strap configured to engage with a selected one of the plurality of spaced-apart grooves.

In still a further embodiment, the safety gate locking strap further comprises a base plate disposed proximate to a base of the protrusion, the protrusion coupled to, and extending from, the base plate, the base plate being disposed against a first side of the strap portion.

In yet a further embodiment, the safety gate locking strap further comprises a fastener member attaching the base plate to the strap portion, the fastener member including a head portion and a shaft portion, the head portion of the fastener member being disposed on a second side of the strap portion, the second side of the strap portion being disposed opposite to the first side of the strap portion, and the shaft portion of the fastener member either forming the protrusion or the shaft portion of the fastener member attaching the protrusion to the strap portion.

In still a further embodiment, the body portion of the safety gate further comprises a first section and a second section, at least one of the first section and the second section being slidable relative to the other so as to allow a width of the safety gate to be selectively adjusted by a user so as to accommodate for different room opening widths.

In yet a further embodiment, the safety gate further comprises a primary latching device for preventing the opening of the safety gate by the child or pet, and wherein the safety gate locking strap comprises a secondary or supplemental latching device for further preventing the opening of the safety gate by the child or pet so that the safety gate is not capable of being opened even if the primary latching device is disengaged by the child or pet.

In still a further embodiment, the fastening member of the safety gate locking strap comprises a strap buckle with a first buckle portion and a second buckle portion, the first buckle portion configured to be engaged to, and disengaged from, the second buckle portion.

In yet a further embodiment, the first buckle portion of the fastening member of the safety gate locking strap comprises at least one resilient locking tab and the second buckle portion of the fastening member of the safety gate locking strap comprises at least one tab receiving aperture, the first buckle portion configured to be engaged to, and disengaged from, the second buckle portion by means of a selective engagement between the at least one resilient locking tab and the at least one tab receiving aperture.

In accordance with yet one or more other embodiments of the present invention, there is provided a method of securing a safety gate so as to prevent an opening of the safety gate by a child or pet. The method comprises the steps of: (i) providing a safety gate configured to extend across a door opening or other opening into a room, the safety gate including a body portion with a first securement component and a second securement component; (ii) providing a safety gate locking strap configured to prevent an opening of the safety gate by a child or pet, the safety gate locking strap including a strap portion having a first end portion and a second end portion, the first end portion of the strap portion being disposed opposite to the second end portion; and a fastening member coupled to the strap portion, the fastening member configured to enable the first end portion of the strap portion to be engaged to, and disengaged from, the second end portion of the strap portion by a user; (iii) circumscribing a cross-section of the first securement component and the second securement component of the body portion of the safety gate using the strap portion of the safety gate locking strap; and (iv) engaging the first end portion of the strap portion of the safety gate locking strap with the second end portion of the strap portion using the fastening member of the safety gate locking strap so as to secure the first securement component of the safety gate to the second securement component of the safety gate and prevent the opening of the safety gate by the child or pet.

In a further embodiment of the present invention, the at least one of the first securement component and the second securement component of the safety gate comprises at least one groove formed therein, and the safety gate locking strap further comprises a protrusion extending from the strap portion. In this further embodiment, the method further comprises the step of engaging the protrusion of the safety gate locking strap with the at least one groove formed in the at least one of the first securement component and the second securement component of the body portion of the safety gate so as to further prevent the first and second securement components from becoming disengaged from one another and the safety gate from being opened.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
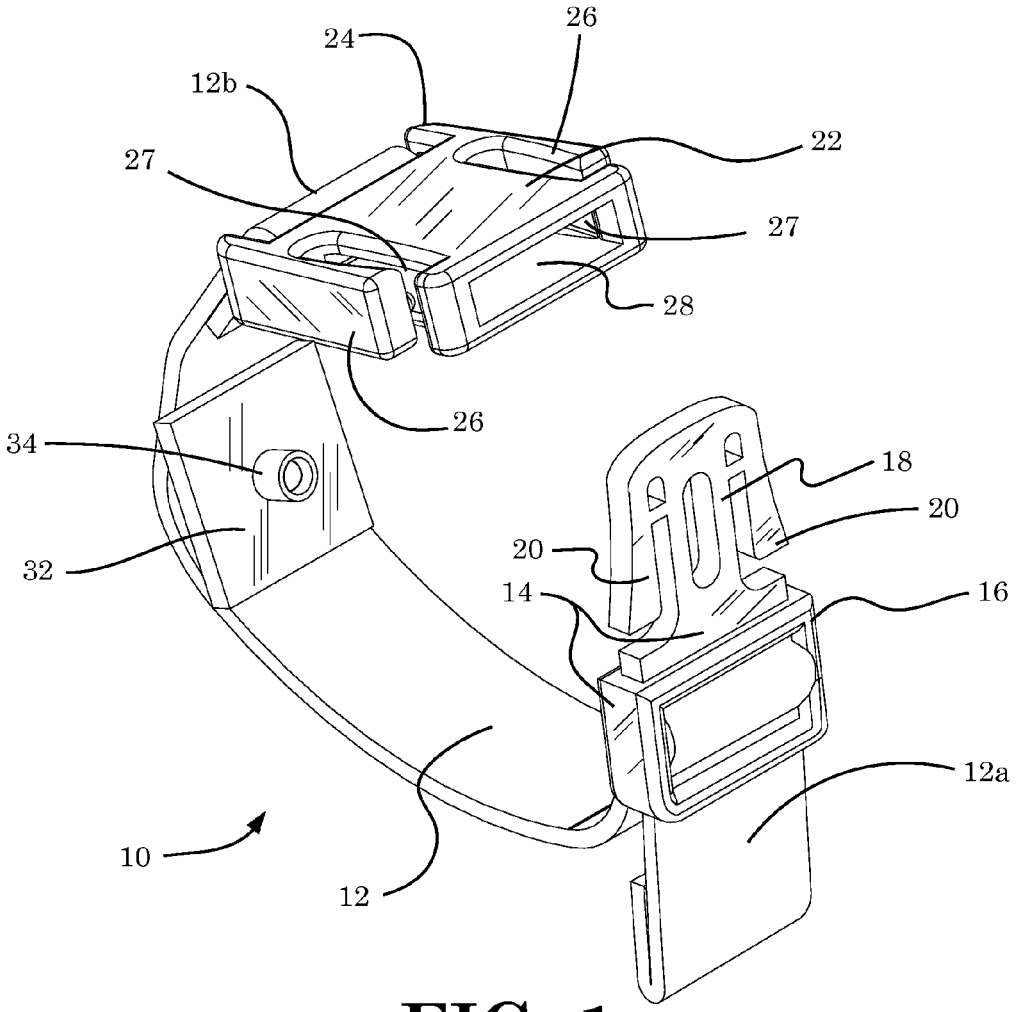
FIG. 1 is a perspective view of a safety gate locking strap in an open, disengaged position, according to an embodiment of the invention.
Figure 2:
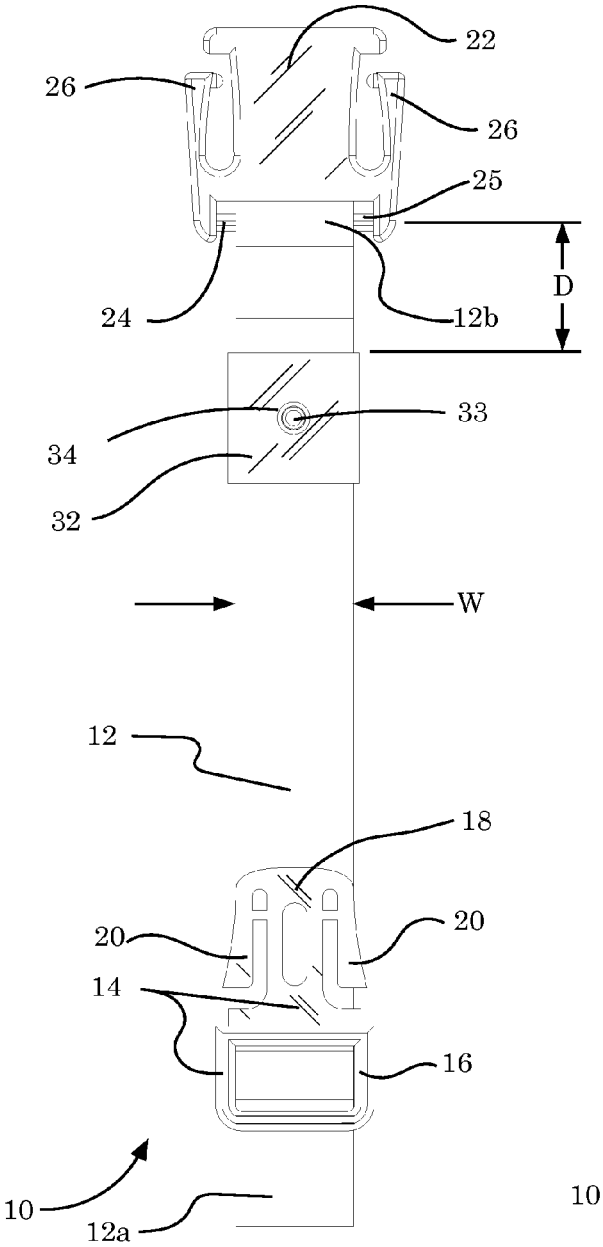
FIG. 2 is a rear view of the safety gate locking strap of FIG. 1, wherein the safety gate locking strap is disposed in an open, flat position.
Figure 3:
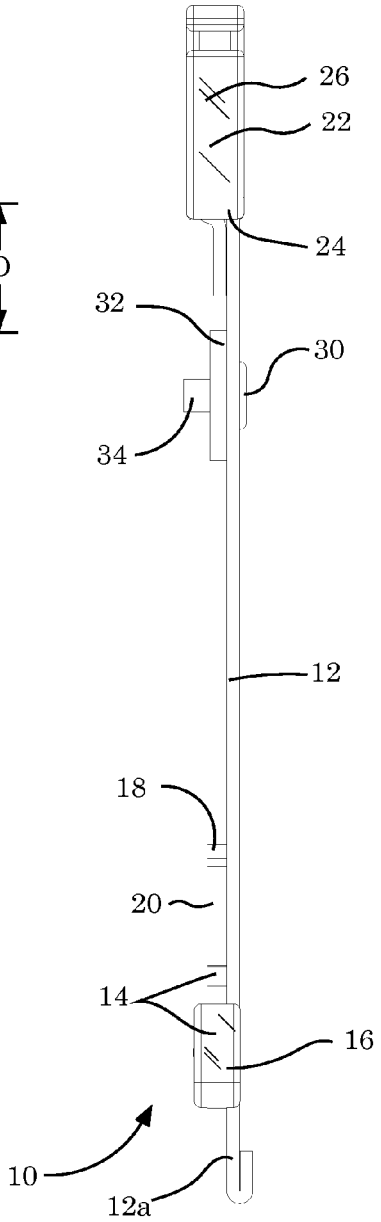
FIG. 3 is a side view of the safety gate locking strap of FIG. 1, wherein the safety gate locking strap is disposed in an open, flat position.
Figure 4:
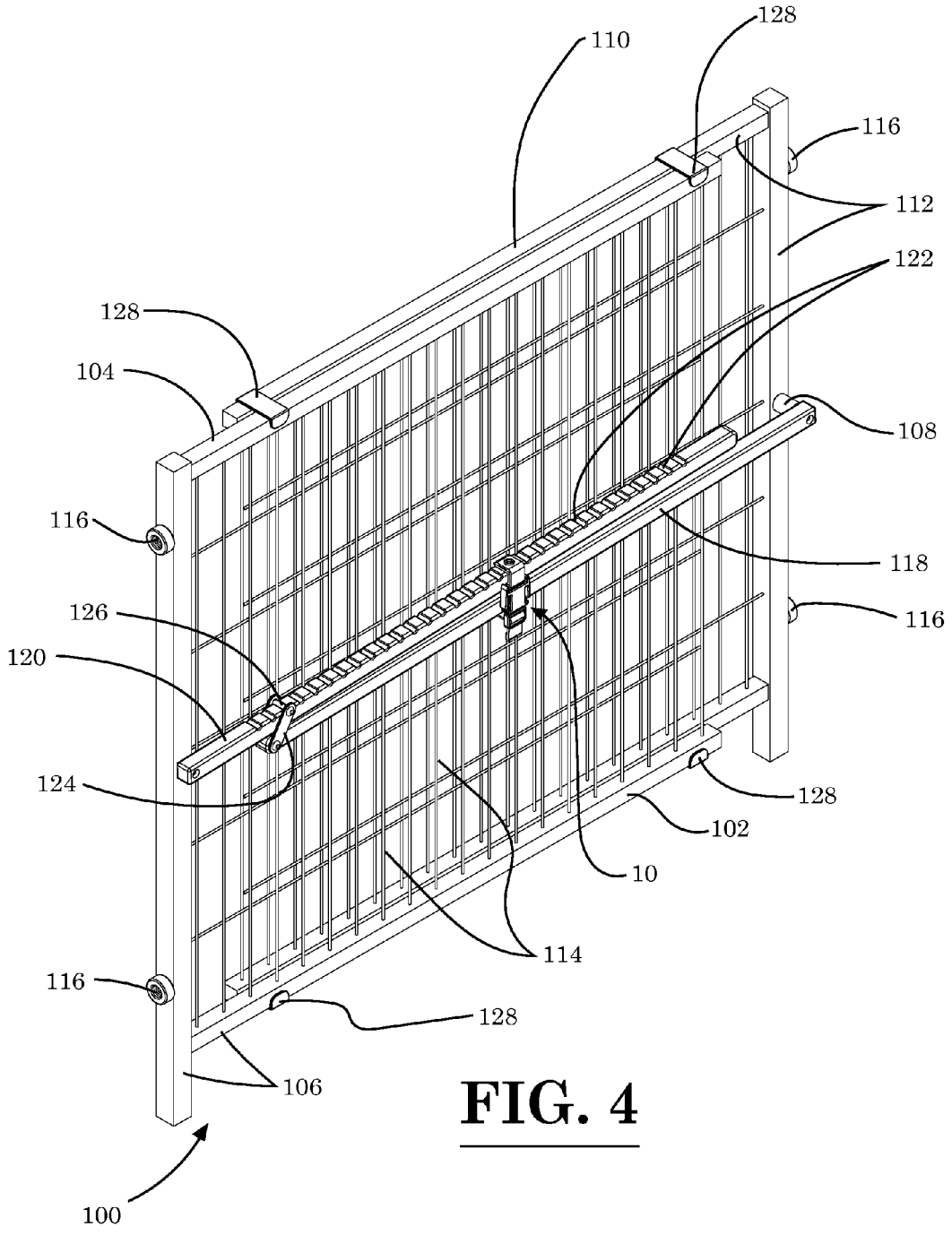
FIG. 4 is a perspective view of a safety gate locking strap installed on a safety gate, according to an embodiment of the invention.
Figure 5:
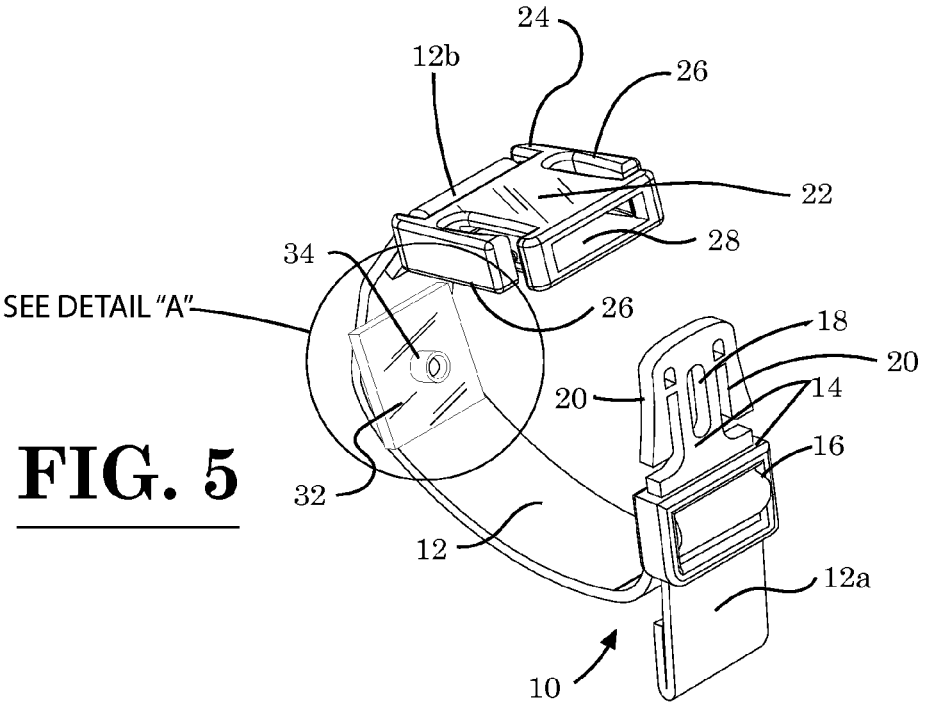
FIG. 5 is another perspective view of the safety gate locking strap of FIG. 1 in an open, disengaged position.
Figure 6:
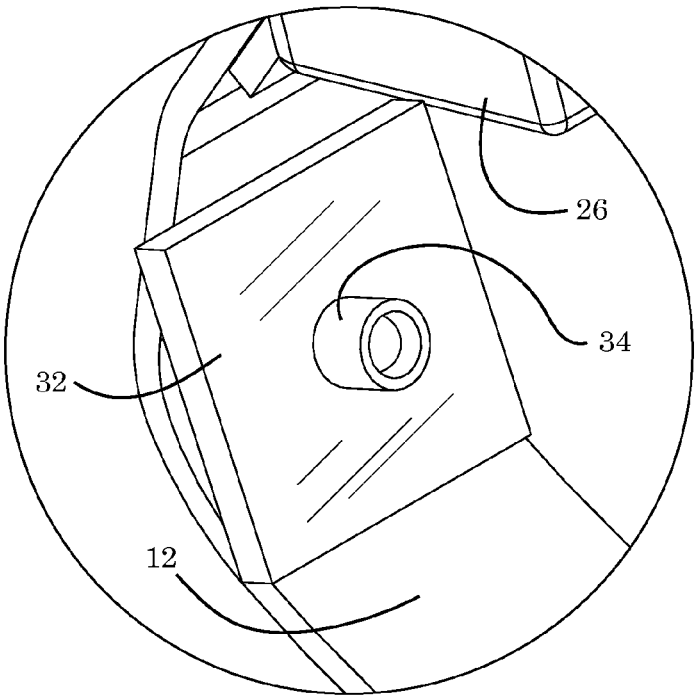
FIG. 6 is a partial, enlarged perspective view of the safety gate locking strap of FIG. 5 (Detail "A")
Figure 8:
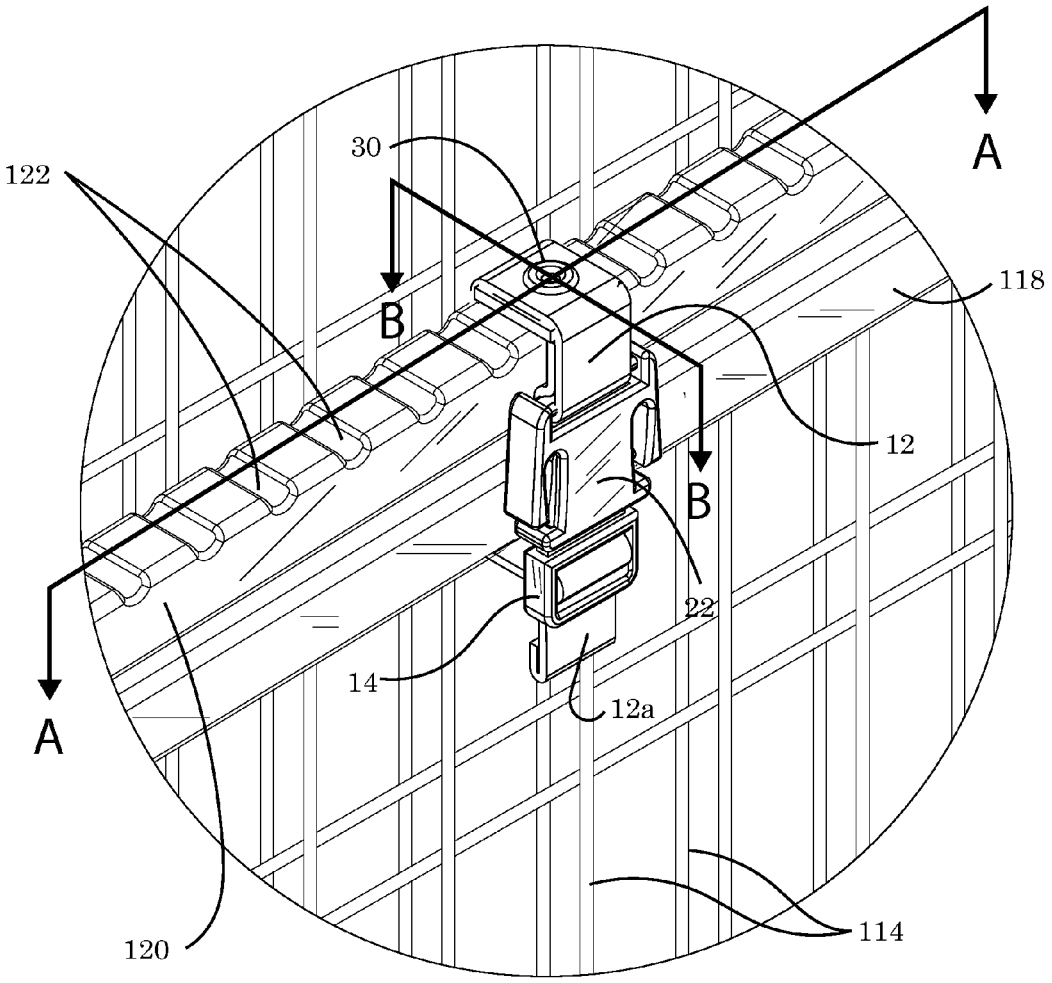
FIG. 8 is another partial, enlarged perspective view of the safety gate locking strap and safety gate of FIG. 4, wherein the safety gate locking strap is illustrated in a closed, engaged position.
Figure 11:
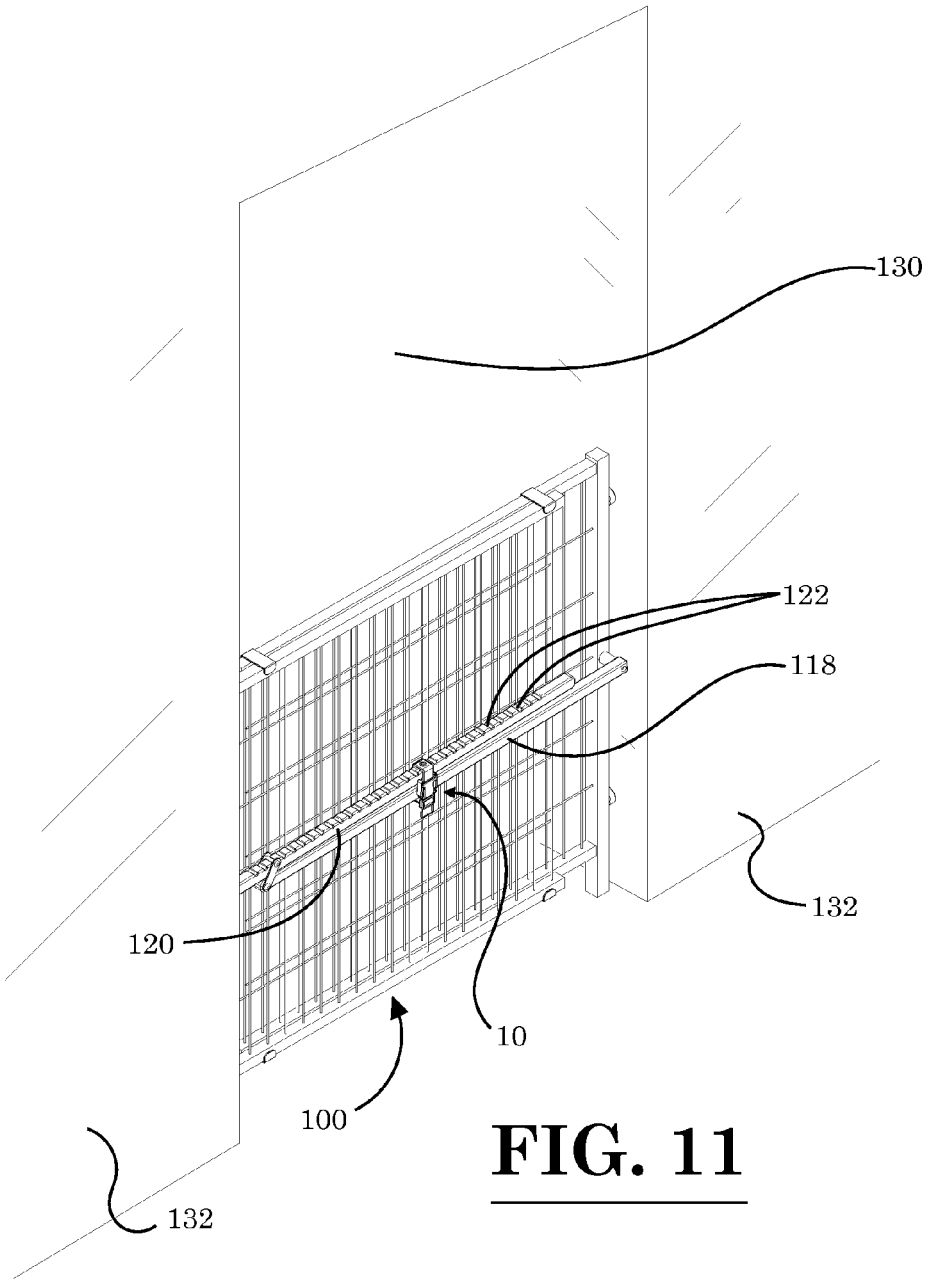
FIG. 11 is a perspective view of the safety gate and safety gate locking strap of FIG. 4 shown installed in a door opening of a wall.

An illustrative embodiment of a safety gate assembly is seen generally at 100 in FIGS. 4 and 11. The safety gate assembly 100 is configured to prevent a child or a pet from entering a particular room in a dwelling structure. As shown in these figures, the safety gate assembly 100 generally comprises a safety gate 102 configured to extend across a door opening or other opening into a room (e.g., door opening 130 in wall 132 of FIG. 11), the safety gate 102 including a body portion 104, 110 with a first securement component (e.g., pivotal lower locking bar 118) and a second securement component (e.g., pivotal upper locking bar 120); and a safety gate locking strap 10 that prevents an opening of the safety gate 102 by a child or pet. Turning to FIGS. 1 and 5, it can be seen that the safety gate locking strap 10 generally includes a strap portion 12 having a first end portion 12*a* and a second end portion 12*b*, the first end portion 12*a* of the strap portion 12 being disposed opposite to the second end portion 12*b*; and a fastening member (e.g., buckle with portions 14, 22) coupled to the strap portion 12, the fastening member 14, 22 configured to enable the first end portion 12*a* of the strap portion 12 to be engaged to, and disengaged from, the second end portion 12*b* of the strap portion 12 by a user. As shown in FIGS. 4, 8, and 11, when the first end portion 12*a* of the strap portion 12 is engaged with the second end portion 12*b* by the fastener member 14, 22, the strap portion 12 of the safety gate locking strap 10 circumscribes the first and second securement components 118, 120 (i.e., wraps around the first and second securement components 118, 120) of the safety gate 102 so as to prevent the first and second securement components 118, 120 from becoming disengaged from one another and thereby prevent the safety gate 102 from being opened.

With reference to the perspective view of FIG. 4, the illustrative embodiment of the safety gate 102 will be described. As shown in this figure, the safety gate 102 comprises a first section 104 and second section 110, each of which is slidable relative to the other so as to allow the width of the safety gate 102 to be selectively adjusted by a user in order to accommodate different room opening widths. The slidable nature of the first and second sections 104, 110 of the safety gate 102 also permits the safety gate 102 to be securely engaged against the opposed sides of a door opening (e.g., against the sides of the door opening 130 in FIG. 11). Turning again to FIG. 4, it can be seen that the first and second sections 104, 110 slide relative to one another on guide tabs 128. The guide tabs 128 also help to hold the first and second sections 104, 110 of the safety gate 102 together. In FIG. 4, it can be seen that the first section 104 of the safety gate 102 comprises a mesh or screen portion 114 bounded by a peripheral frame portion 106. Similarly, the second section 110 of the safety gate 102 comprises a mesh or screen portion 114 bounded by a peripheral frame portion 112. The mesh or screen portion 114 of the safety gate 102 prevents a child or pet from passing through the safety gate 102 and into the prohibited room of the dwelling.

Figure 7:
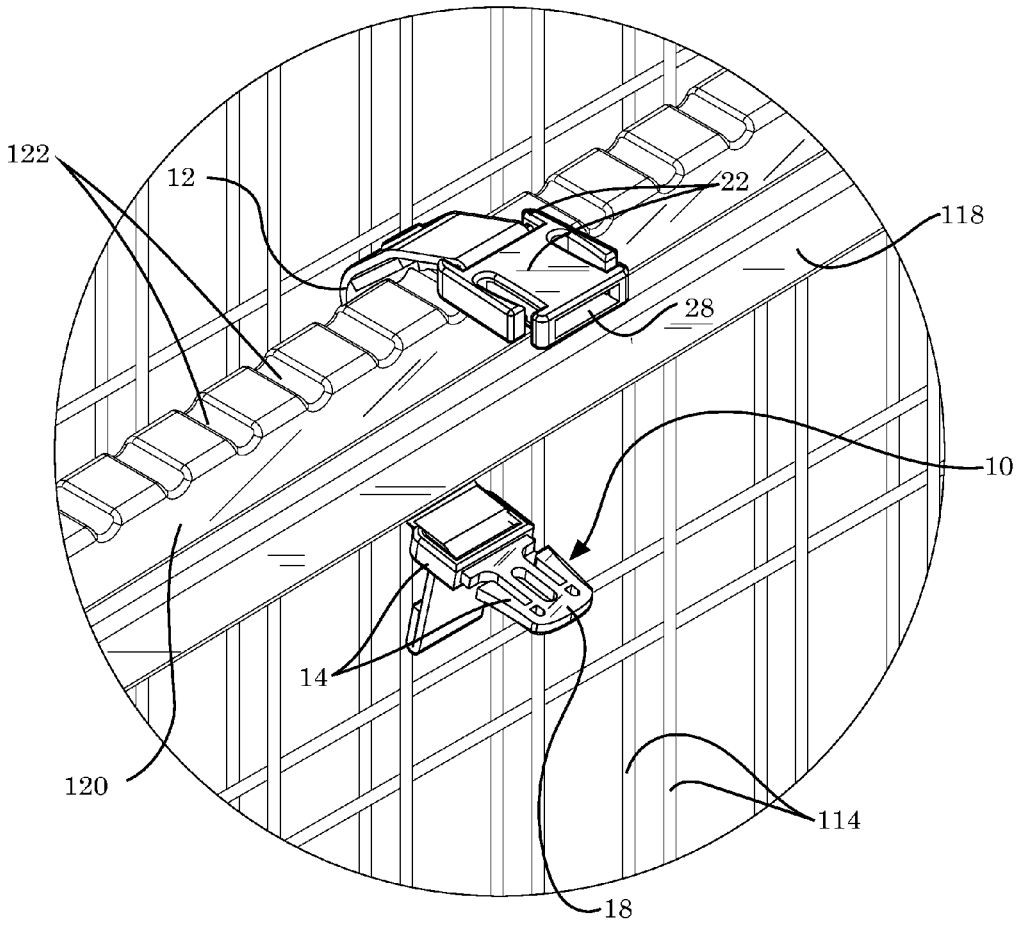
FIG. 7 is a partial, enlarged perspective view of the safety gate locking strap and safety gate of FIG. 4, wherein the safety gate locking strap is illustrated in an open, disengaged position.

In the illustrative embodiment of FIG. 4, it can be seen that the safety gate 102 is provided with a pivotal lower locking bar 118 and a pivotal upper locking bar 120. The pivotal lower locking bar 118 and the pivotal upper locking bar 120 form the respective first and second securement components of the safety gate 102 in the illustrative embodiment. As shown in FIG. 4, pivotal locking bars 118, 120 are disposed generally parallel with one another, and they are generally aligned with one another in a generally vertical plane. In order to effectuate this alignment, the pivotal lower locking bar 118 is provided with a horizontally-extending cylindrical spacer member 108 that is approximately equal to the width of the peripheral frame portion 106 of the first section 104 so that the pivotal lower locking bar 118 is generally disposed directly beneath the pivotal upper locking bar 120. As best shown in FIGS. 4, 7, and 8, the pivotal upper locking bar 120 is provided with a plurality of transversely-extending grooves 122 formed in the top surface thereof. Each of the plurality of transversely-extending grooves 122 is generally equally spaced apart from one another along a length of the pivotal upper locking bar 120. In FIG. 4, it can be seen that the illustrative safety gate 102 includes a pivotal latching member 124 that may serve as one latching device of the safety gate 102. The lower end of the pivotal latching member 124 is pivotally mounted to the distal end of the pivotal lower locking bar 118 by means of a pin, while the upper end of the pivotal latching member 124 comprises a latching pin 126 that engages with a selected one of the transversely-extending grooves 122 (i.e., third-to-last groove in FIG. 4). In one or more embodiments, the pivotal latching member 124 may serve as the primary latching device of the safety gate 102, while the safety gate locking strap 10 that will be described in detail hereinafter may serve as a secondary or supplemental latching device preventing the opening of the safety gate 102 by a child or pet even if the primary latching device (i.e., pivotal latching member 124) is disengaged by the child or pet.

In an exemplary embodiment, the peripheral frame portions 106, 112 and the pivotal locking bars 118, 120 of the safety gate 102 are formed from wood, while the mesh or screen portion 114 is formed from a suitable polymeric material or plastic. Although, those of ordinary skill in the art will appreciate that the constituent components of the safety gate 102 can be formed from various other suitable materials, provided that the selected materials are suitably durable and lightweight.

Referring collectively to FIGS. 4 and 11, it can be seen that each opposed outer side of the illustrative safety gate 102 comprises a pair of spaced-apart wall bumpers 116 disposed thereon for protecting the wall opening surface against which the safety gate 102 is placed (e.g., by preventing scratches, etc.). Advantageously, the compressible nature of the wall bumpers 116 also enables the safety gate 102 to be tightly engaged against the opposed wall opening surface so as to create secure engagement within the wall opening. In an exemplary embodiment, the wall bumpers 116 may each be formed from a resilient material, such as a suitable elastically compressible rubber or polymeric material.

Now, with reference to FIGS. 1-3, 5, and 6, the illustrative embodiment of the safety gate locking strap 10 of the safety gate assembly 100 will be described in detail. As explained above, the safety gate locking strap 10 generally includes a strap portion 12 and a fastening member 14, 22. In the illustrative embodiment, the fastening member of the safety gate locking strap 10 comprises a strap buckle with a first buckle portion 14 and a second buckle portion 22. The first buckle portion 14 engages with, and disengages from, the second buckle portion 22 (e.g., refer to FIGS. 7 and 8). As best illustrated in FIGS. 1 and 5, the first buckle portion 14 comprises a tongue member 18 and the second buckle portion 22 comprises a recess 28 for receiving the tongue member 18 of the first buckle portion 14. In FIG. 1, it can be seen that the first buckle portion 14 comprises a pair of resilient locking tabs 20. Each of the pair of resilient locking tabs 20 is disposed on an opposite side of the tongue member 18 of the first buckle portion 14. The second buckle portion 22 comprises a pair of tab receiving apertures 27, each of which corresponds to a respective one of the pair of resilient locking tabs 20 on the first buckle portion 14. As shown in FIG. 1, each of the pair of tab receiving apertures 27 is disposed on an opposite side of the recess 28 of the second buckle portion 22, and each of the pair of tab receiving apertures 27 is configured to receive a respective one of the pair of resilient locking tabs 20 of the first buckle portion 14. As such, the first buckle portion 14 engages with, and disengages from, the second buckle portion 22 by means of a selective engagement between a respective one of the pair of resilient locking tabs 20 with a respective one of the pair of tab receiving apertures 27. In FIG. 1, it can be seen that the second buckle portion 22 further includes a pair of side release tabs 26 disposed on opposite sides thereof. The strap buckle in the illustrated embodiment comprises a side release-type buckle that can be disengaged by a user thereof when he or she applies an inward, compressive force to the side release tabs 26 of the second buckle portion 22.

Figure 10:
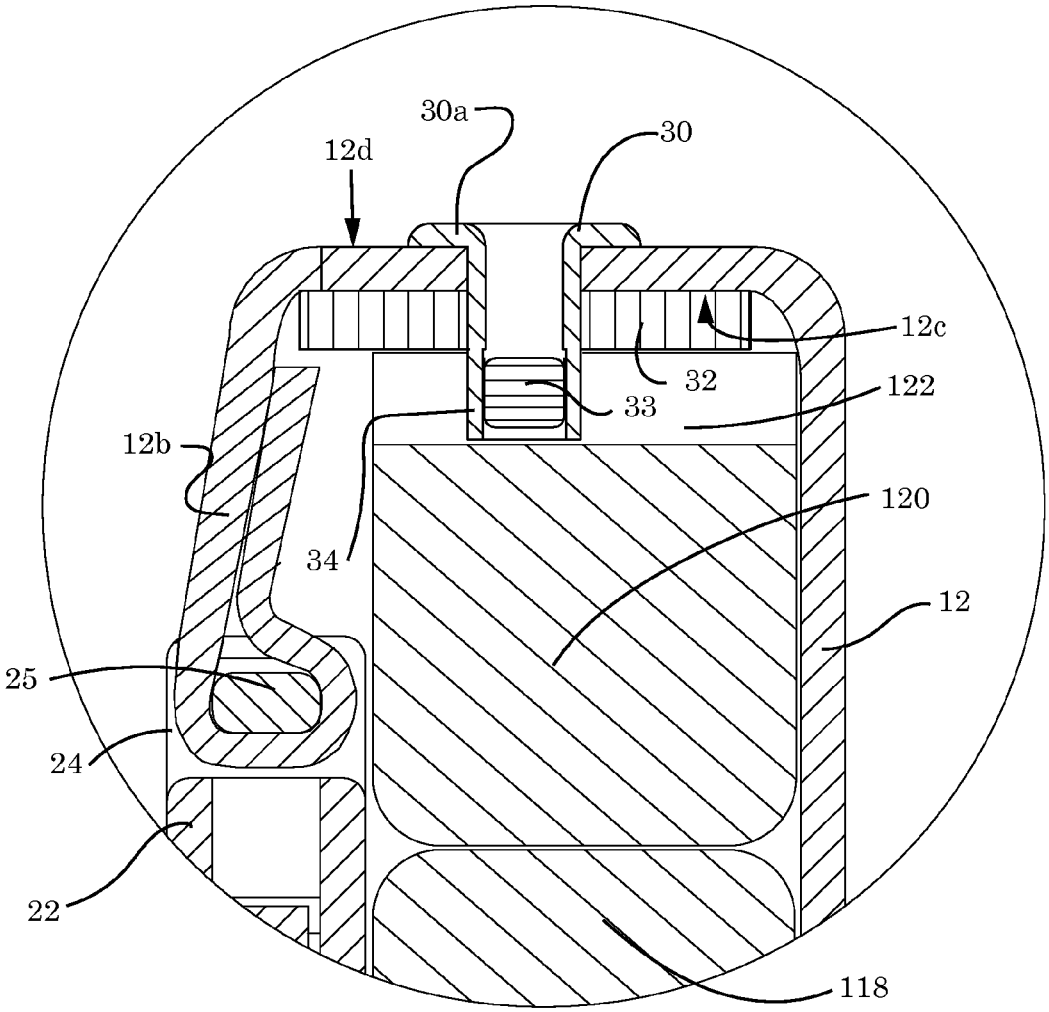
FIG. 10 is an enlarged, transverse sectional view of the safety gate and safety gate locking strap of FIG. 8, which is generally cut along the cutting-plane line B-B in FIG. 8.

Referring again to FIGS. 1-3 and 5, it can be seen that the first buckle portion 14 further includes a first strap retention portion 16 for attaching the first end portion 12*a* of the strap portion 12 to the first buckle portion 14. Similarly, the second buckle portion 22 also includes a second strap retention portion 24 for attaching the second end portion 12*b* of the strap portion 12 to the second buckle portion 22. In FIG. 10, it can be seen that the second strap retention portion 24 of the second buckle portion 22 comprises a strap hanger member 25 that the second end portion 12*b* of the strap portion 12 wraps around. The first strap retention portion 16 of the first buckle portion 14 comprises a strap hanger member, which is similar to strap hanger member 25, that the first end portion 12*a* of the strap portion 12 wraps around. In the illustrated embodiment, the first end portion 12*a* of the strap portion 12 is adjustable, whereas the second end portion 12*b* of the strap portion 12 is not adjustable. That is, in the illustrative embodiment, the circumscribing length of the strap portion 12 can be adjusted by increasing or decreasing the length of the first end portion 12*a* of the strap portion 12 protruding from the first strap retention portion 16 (i.e., by adjusting the free end length of the strap portion 12). In another embodiment, both the first and second end portions 12*a*, 12*b* of the strap portion 12 may be adjustable so that the safety gate locking strap 10 has dual adjustment capabilities.

In one or more embodiments, the second end portion 12*b* of the strap portion 12 is sewn in a closed-loop fashion to the strap hanger member 25 of the second strap retention portion 24 (see FIG. 10), while the first end portion 12*a* of the strap portion 12 is pulled through, and looped around, the strap hanger member of the second strap retention portion 16 with its free end remaining unattached so that the length between the first and second buckle portions 14, 22 may be adjusted.

Figure 9:
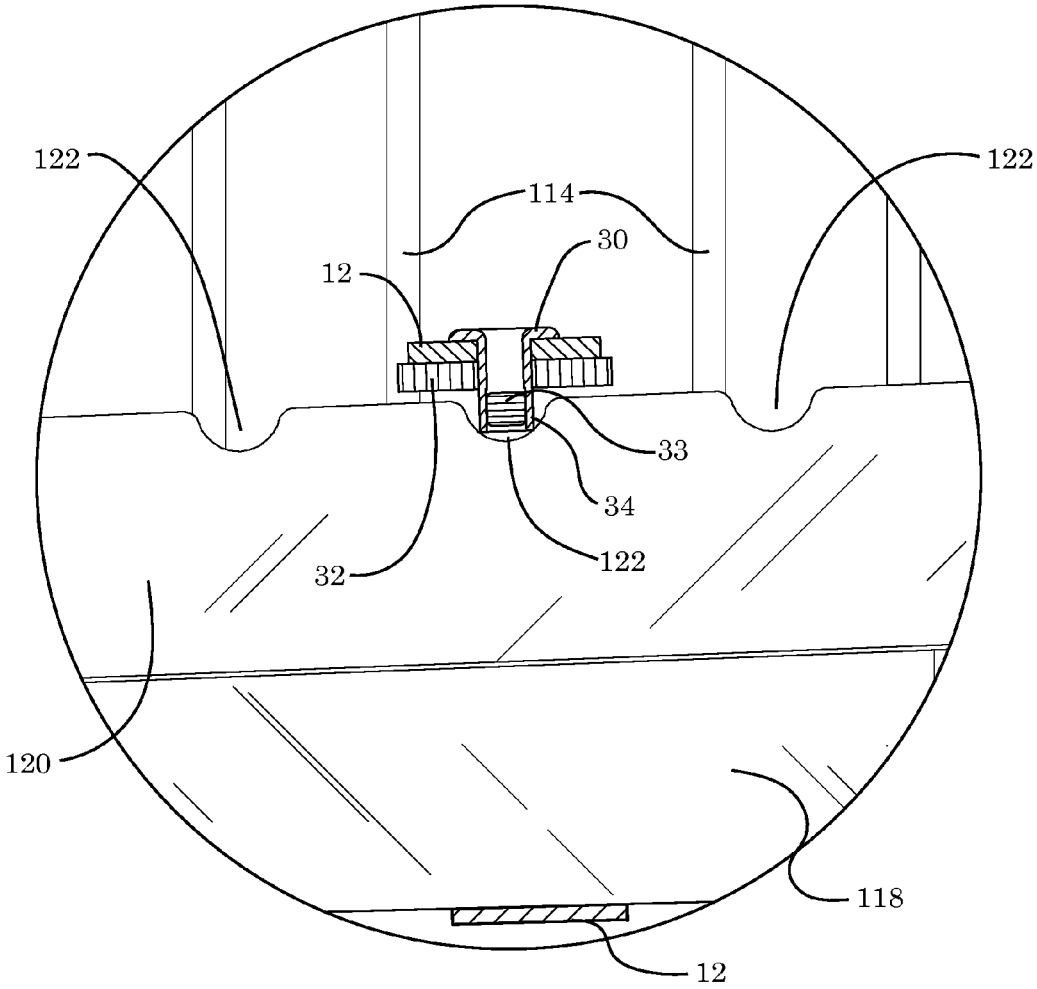
FIG. 9 is an enlarged, longitudinal sectional view of the safety gate and safety gate locking strap of FIG. 8, which is generally cut along the cutting-plane line A-A in FIG. 8.

As shown in FIGS. 1-3 and 5, in the illustrative embodiment, the safety gate locking strap 10 further includes a tubular protrusion 34 extending from the strap portion 12. As best illustrated in the cross-sectional views of FIGS. 9 and 10, the protrusion 34 engages with a selected one of the transversely-extending grooves 122 in the pivotal upper locking bar 120 of the safety gate 102 so as to prevent the safety gate 102 from being opened by a child or a pet. With combined reference to FIGS. 1, 2, 5, 6, 9, and 10, it can be seen that the safety gate locking strap 10 also includes a base plate 32 disposed proximate to a base of the tubular protrusion 34. The tubular protrusion 34 is coupled to, and extends from, approximately the center of the base plate 32. The tubular protrusion 34 may be dimensioned such that its axial length is substantially equal to the groove depth of the transverse grooves 122 in the pivotal upper locking bar 120 (see e.g., FIG. 10), thereby enabling the outer planar surface of the base plate 32 to lie generally contiguous to the upper surface of the pivotal upper locking bar 120. Also, as shown in FIGS. 1, 5, 9, and 10, the base plate 32 is disposed against a first side 12*c* of the strap portion 12. In one or more embodiments, the base plate 32 may be integrally formed with the tubular protrusion 34 disposed thereon. In one or more other embodiments, the base plate 32 and tubular protrusion 34 may each be separate components, and then subsequently attached to one another (e.g., as described hereinafter). Turning to FIGS. 3 and 8-10, it can be seen that the safety gate locking strap 10 further includes a fastener member 30 attaching the base plate 32 to the strap portion 12 (i.e., as shown in FIGS. 9 and 10, the strap portion 12 is sandwiched between the head 30*a* of the fastener member 30 and the base plate 32). As shown in FIGS. 8-10, the head portion 30*a* of the fastener member 30 is disposed on a second side 12*d* of the strap portion 12. The second side 12*d* of the strap portion 12 is disposed opposite to the first side 12*c* of the strap portion 12. In the illustrative embodiment, the fastener member 30 is in the form of a pop rivet (see e.g., FIGS. 8 and 10). However, it is to be understood that, in other embodiments, the fastener member may comprise other suitable fastening means, such as a screw or locking pin. In the illustrated embodiment, the tubular protrusion 34 is actually formed by the shaft portion of the pop rivet 30 (see e.g., FIGS. 9 and 10). In order to secure the pop rivet 30 in place, the sheared portion of the rivet pin 33 is wedged into the end portion of the tubular shaft portion 34 of the pop rivet 30 in order to force its tubular shaft portion 34 to bulge radially outward, thereby securing the base plate 32 to the strap portion 12 by means of the pop rivet 30. In other embodiments, when fastener members other than pop rivets are used (e.g., when screw or locking pins are used), the shaft portion of the fastener member may attach the tubular protrusion 34 to the strap portion 12, rather than actually forming the tubular protrusion 34 as is the case in the illustrative embodiment.

In an exemplary embodiment, the strap portion 12 of the safety gate locking strap 10 has an overall length of approximately six (6) inches and overall width W of approximately one-half (½) of an inch (see e.g., FIG. 2), while the footprint of the base plate 32 is approximately one-half (½) of an inch by one-half (½) of an inch, and the pop rivet 30 is approximately four thirty-seconds (4/32) of an inch wide. Also, in an exemplary embodiment, the distance D between the edge of the base plate 32, which is closest to the second buckle portion 22, and the centerline of the strap hanger member 25 is approximately five-eighths (5/8) of an inch (see e.g., FIG. 2). Although, it is to be understood that the safety gate locking strap 10 is not limited to these particular dimensions. Rather, the safety gate locking strap 10 may be practiced using any other suitable dimensions without departing from the spirit and scope of the appended claims.

In the exemplary embodiment, the five-eighths (5/8) inch spacing between the base plate 32 and the strap hanger member 25 advantageously permits the fastening member (i.e., buckle) to be properly positioned on the back side of the pivotal locking bars 118, 120 so that it is readily accessible to an adult when it is necessary to remove the safety gate 102 (e.g., as shown in FIG. 8). Without the proper spacing between the base plate 32 and the strap hanger member 25, the fastening member (i.e., buckle) might be awkwardly positioned on one of the corners of the pivotal locking bars 118, 120, thereby making the engagement between the safety gate locking strap 10 and the safety gate 102 less secure.

In one or more embodiments, the safety gate locking strap 10 has a small size (e.g., with a width W of approximately only one-half (½) of an inch) so that it is very difficult for a child to be able to reach over and open the safety gate 102, likewise it is nearly impossible for a child to reach through the gate mesh 114 and open the side release buckle of the safety gate locking strap 10.

Also, in an exemplary embodiment, the strap portion 12 of the safety gate locking strap 10 is formed from woven nylon webbing with stitched first and second end portions 12*a*, 12*b*, the first and second buckle portions 14, 22 are formed from a suitable polymeric material or plastic (e.g., acrylonitrile butadiene styrene (ABS)), and the fastener member 30 with tubular protrusion 34 and the base plate 32 are formed from a suitable metal (e.g., galvanized steel, stainless steel, or aluminum). For example, in one or more embodiments, the base plate 32 may be in the form of a metallic washer. Although, those of ordinary skill in the art will appreciate that the constituent components of the safety gate locking strap 10 can be formed from various other suitable materials, provided that the selected materials are suitably durable for locking the pivotal lower and upper locking bars 118, 120 of the safety gate 102 in place.

Now, referring primarily to FIGS. 4, 7, 8, and 11, an illustrative method of securing a safety gate 102 which utilizes the aforedescribed safety gate assembly 100 will be described. Initially, the safety gate 102 is adjusted to the appropriate width of the door opening or room opening it is being placed in, and then it is secured in place within the opening (e.g., as shown in FIG. 11, the safety gate 102 is secured within the door opening 130 in the wall 132). If the safety gate 102 has a primary latching device, such as the pivotal latching member 124 described above, the primary latching device is secured after the safety gate 102 is placed within the door opening or room opening. Then, with particular reference to FIG. 7, the safety gate locking strap 10 is placed around the pivotal lower and upper locking bars 118, 120 of the safety gate 102 by a user such that it circumscribes a transverse cross-section of both locking bars 118, 120. During the positioning of the safety gate locking strap 10 around the locking bars 118, 120 of the safety gate 102, the protrusion 34 of the safety gate locking strap 10 is inserted into one of the plurality of transversely-extending grooves 122 disposed in the top surface of the pivotal upper locking bar 120 (i.e., a user selects one of the grooves 122 in the pivotal upper locking bar 120, and inserts the protrusion 34 of the safety gate locking strap 10 therein). Finally, after the protrusion 34 of the safety gate locking strap 10 has been inserted into one of the grooves 122 of the locking bar 120, the first end portion 12*a* of the strap portion 12 of the safety gate locking strap 10 is engaged with the second end portion 12*b* of the strap portion 12 by fastening the first and second buckle portions 14, 22 of the fastening member together (see FIG. 8). That is, a user inserts the first buckle portion 14 with tongue portion 18 into the tongue-receiving recess 28 of the second buckle portion 22 of the fastening member until the oppositely disposed resilient locking tabs 20 of the first buckle portion 14 snap into place within the corresponding oppositely disposed tab receiving apertures 27 of the second buckle portion 22. After the first and second buckle portions 14, 22 of the fastening member are removably affixed together, the safety gate locking strap 10 secures the locking bars 118, 120 of the safety gate 102 to one another so as to prevent the opening of the safety gate 102 by a child or pet. If the length of the strap portion 12 requires an adjustment (i.e., a reduction in length), the user may simply apply a tensile force to the free end portion 12*a* of the strap portion 12 to tighten the safety gate locking strap 10. Once in place, the safety gate locking strap 10 advantageously prevents the locking bars or arms 118, 120 from being pushed up, therefore making the safety gate 102 a stronger and more secure barrier. For example, once the safety gate locking strap 10 is securely attached to the safety gate 102, it is virtually impossible for a small child to push up, and disengage the pivotal upper locking bar 120 of the safety gate 102 by either reaching over the gate 102 or putting fingers through the mesh 114 of the gate 102 and lifting up the bar 120. The safety gate locking strap 10 locks the gate bar arm 120 securely into place, thereby preventing the safety gate 102 from being opened by a small child or pet. Once the safety gate locking strap 10 is closed, and secured in place, it is nearly impossible for a small child to stick his or her hand thru the mesh 114 of the safety gate 102 and to lift up the closed locking bar 120.

Next, referring again to FIGS. 4, 7, 8, and 11, an illustrative manner in which the safety gate locking strap 10 is disengaged from the safety gate 102 will be explained. First, the user of safety gate locking strap 10 releases the fastening device of the strap 10 by applying a compressive force against each of the oppositely disposed side release tabs 26 of the second buckle portion 22 (i.e., by squeezing the oppositely disposed side release tabs 26 of the second buckle portion 22). When the compressive force is applied against each of the oppositely disposed side release tabs 26 of the second buckle portion 22 by the user, the tabs 26, in turn, respectively engage the resilient locking tabs 20 of the first buckle portion 14 and disengage each of the locking tabs 20 from their respective tab receiving apertures 27. After the resilient locking tabs 20 of the first buckle portion 14 are disengaged from their respective tab receiving apertures 27 in the second buckle portion 22, the end portions 12*a*, 12*b* of the strap portion 12 are able to be separated from one another, and the safety gate locking strap 10 is able to be removed from its circumscribing engagement around the locking bars 118, 120 of the safety gate 102. Once the safety gate locking strap 10 is removed from the locking bars 118, 120 of the safety gate 102, the user may then disengage the latching pin 126 of the pivotal latching member 124 from the groove 122 of the locking bar 120 in which it is disposed. After the pivotal latching member 124 is released, the user lifts up on the upper locking bar 120 and slides the first section 104 of the gate 102 relative to the second section 110 of the gate 102 so that the extending width of the safety gate 102 is able to be reduced, and the gate 102 is able to be removed from the door opening or other wall opening.

It is readily apparent that the aforedescribed safety gate locking strap 10 and the safety gate assembly 100 using the same offers numerous advantages. First, the safety gate locking strap 10 is capable of preventing the unwanted opening of a portable room barrier device or safety gate 102 by a small child or pet. That is, the safety gate locking strap 10 provides a simple means of securing safety gate 102 so as to prevent the unintended opening of the safety gate 102 by a child or pet. Secondly, the safety gate assembly 100 described herein effectively prevents the unwanted opening of the safety gate 102 by utilizing a safety gate locking strap 10 that is virtually unable to be disengaged by a small child or pet. Finally, the safety gate locking strap 10 prevents the unwanted opening of the safety gate 102, but does not substantially interfere with the portability of the safety gate 102 or the ability of an adult to remove the safety gate 102 when desired.

In one or more embodiments, the safety gate locking strap 10 described herein may be used in conjunction with pressure-mounted gates or lock gates of varying heights to prevent the undesirable opening of the gates. For example, the adjustability of the length of the safety gate locking strap 10 enables it to be used in conjunction with pressure-mounted gates with heights ranging from approximately twenty-three (23) inches to approximately thirty-three (33) inches, inclusive (e.g., from twenty-three (23) inches to thirty-three (33) inches, inclusive). Thus, by virtue of its adjustability, the illustrative safety gate locking strap 10 described herein prevents a small child or pet from opening various types of pressure-mounted gates.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A safety gate assembly configured to prevent a child or a pet from entering a particular room in a dwelling structure, said safety gate assembly comprising:

a safety gate configured to extend across a door opening or other opening into a room, said safety gate including a body portion with a first securement component and a second securement component, at least one of said first securement component and said second securement component of said safety gate comprising at least one groove formed therein; and a safety gate locking strap configured to prevent an opening of said safety gate by a child or pet, said safety gate locking strap including:

a strap portion having a first inner side and a second outer side, said first inner side configured to face towards said first and second securement components of said safety gate, said second outer side configured to face away from said first and second securement components of said safety gate and being disposed opposite to said first inner side, said strap portion further including a first end portion and a second end portion, said first end portion of said strap portion being disposed opposite to said second end portion;

a fastening member coupled to said strap portion, said fastening member configured to enable said first end portion of said strap portion to be engaged to, and disengaged from, said second end portion of said strap portion by a user; and a protrusion extending from said first inner side of said strap portion;

wherein, when said first end portion of said strap portion is engaged with said second end portion by said fastener member, said strap portion of said safety gate locking strap is configured to circumscribe said first and second securement components of said safety gate so as to prevent said first and second securement components from becoming disengaged from one another and thereby prevent said safety gate from being opened, and said protrusion is configured to engage with said at least one groove formed in said at least one of said first securement component and said second securement component so as to further prevent said first and second securement components from becoming disengaged from one another and said safety gate from being opened.

2. The safety gate assembly according to claim 1, wherein said at least one groove formed in said at least one of said first securement component and said second securement component comprises a plurality of grooves spaced-apart along a length of said at least one of said first securement component and said second securement component, said protrusion of said safety gate locking strap configured to engage with a selected one of said plurality of spaced-apart grooves.

3. The safety gate assembly according to claim 1, wherein said safety gate locking strap further comprises a base plate disposed proximate to a base of said protrusion, said protrusion coupled to, and extending from, said base plate, said base plate being disposed against said first inner side of said strap portion.

4. The safety gate assembly according to claim 3, wherein said safety gate locking strap further comprises a fastener member attaching said base plate to said strap portion, said fastener member including a head portion and a shaft portion, said head portion of said fastener member being disposed on said second outer side of said strap portion, and said shaft portion of said fastener member either forming said protrusion or said shaft portion of said fastener member attaching said protrusion to said strap portion.

5. The safety gate assembly according to claim 4, wherein said fastener member of said safety gate locking strap comprises one of: (i) a rivet, (ii) a screw, and (iii) a locking pin.

6. The safety gate assembly according to claim 1, wherein said body portion of said safety gate further comprises a first section and a second section, at least one of said first section and said second section being slidable relative to the other so as to allow a width of said safety gate to be selectively adjusted by a user so as to accommodate for different room opening widths.

7. The safety gate assembly according to claim 1, wherein said safety gate further comprises a primary latching device for preventing said opening of said safety gate by said child or pet, and wherein said safety gate locking strap comprises a secondary or supplemental latching device for further preventing said opening of said safety gate by said child or pet so that said safety gate is not capable of being opened even if said primary latching device is disengaged by said child or pet.

8. The safety gate assembly according to claim 1, wherein said fastening member of said safety gate locking strap comprises a strap buckle with a first buckle portion and a second buckle portion, said first buckle portion configured to be engaged to, and disengaged from, said second buckle portion.

9. The safety gate assembly according to claim 8, wherein said first buckle portion of said fastening member of said safety gate locking strap comprises a tongue member and said second buckle portion of said fastening member of said safety gate locking strap comprises a recess for receiving said tongue member of said first buckle portion.

10. The safety gate assembly according to claim 8, wherein said first buckle portion of said fastening member of said safety gate locking strap comprises a first strap retention portion attaching said first end portion of said strap portion to said first buckle portion, and said second buckle portion of said fastening member of said safety gate locking strap comprises a second strap retention portion attaching said second end portion of said strap portion to said second buckle portion, said second strap retention portion comprising a strap hanger member about which said second end portion of said strap portion is attached in a closed-loop manner; and wherein said first end portion of said strap portion is adjustable relative to said first strap retention portion.

11. The safety gate assembly according to claim 8, wherein said first buckle portion of said fastening member of said safety gate locking strap comprises at least one resilient locking tab and said second buckle portion of said fastening member of said safety gate locking strap comprises at least one tab receiving aperture, said first buckle portion configured to be engaged to, and disengaged from, said second buckle portion by means of a selective engagement between said at least one resilient locking tab and said at least one tab receiving aperture.

12. The safety gate assembly according to claim 11, wherein said at least one resilient locking tab of said first buckle portion of said fastening member of said safety gate locking strap comprises a pair of resilient locking tabs, each of said pair of resilient locking tabs being disposed on an opposite side of said tongue member of said first buckle portion; and wherein said at least one tab receiving aperture of said second buckle portion of said fastening member of said safety gate locking strap comprises a pair of tab receiving apertures, each of said pair of tab receiving apertures being disposed on an opposite side of said recess of said second buckle portion, and each of said pair of tab receiving apertures being configured to receive a respective one of said pair of resilient locking tabs of said first buckle portion.

13. The safety gate assembly according to claim 1, wherein said protrusion of said safety gate locking strap comprises an axial length that is substantially equal to a groove depth of said at least one groove formed in said at least one of said first securement component and said second securement component.

14. A method of securing a safety gate so as to prevent an opening of the safety gate by a child or pet, said method comprising the steps of:

providing a safety gate configured to extend across a door opening or other opening into a room, said safety gate including a body portion with a first securement component and a second securement component, at least one of said first securement component and said second securement component of said safety gate comprising at least one groove formed therein;

providing a safety gate locking strap configured to prevent an opening of said safety gate by a child or pet, said safety gate locking strap including:

a strap portion having a first inner side and a second outer side, said first inner side configured to face towards said first and second securement components of said safety gate, said second outer side configured to face away from said first and second securement components of said safety gate and being disposed opposite to said first inner side, said strap portion further including a first end portion and a second end portion, said first end portion of said strap portion being disposed opposite to said second end portion;

a fastening member coupled to said strap portion, said fastening member configured to enable said first end portion of said strap portion to be engaged to, and disengaged from, said second end portion of said strap portion by a user; and a protrusion extending from said first inner side of said strap portion;

circumscribing a cross-section of said first securement component and said second securement component of said body portion of said safety gate using said strap portion of said safety gate locking strap;

engaging said first end portion of said strap portion of said safety gate locking strap with said second end portion of said strap portion using said fastening member of said safety gate locking strap so as to secure said first securement component of said safety gate to said second securement component of said safety gate and prevent said opening of said safety gate by said child or pet; and engaging said protrusion of said safety gate locking strap with said at least one groove formed in said at least one of said first securement component and said second securement component of said body portion of said safety gate so as to further prevent said first and second securement components from becoming disengaged from one another and said safety gate from being opened.

* * * * *